US005193983A

United States Patent [19]

Shyu

[11] Patent Number: 5,193,983

[45] Date of Patent: Mar. 16, 1993

[54] AXIAL-FLOW FAN-BLADE WITH PROFILED GUIDE FINS

[75] Inventor: Jia-Ming Shyu, Hsinchu City, Taiwan

[73] Assignee: Norm Pacific Automation Corp., Hsinchu City, Taiwan

[21] Appl. No.: 740,604

[22] Filed: Aug. 5, 1991

[51] Int. Cl.[5] ..... F04D 29/38; F04D 29/58

[52] U.S. Cl. ..... 416/236 A; 416/236 R

[58] Field of Search ..... 416/235, 236 A, 236 R

[56] References Cited

U.S. PATENT DOCUMENTS

| | | | |
|---|---|---|---|
| 3,294,175 | 12/1966 | Bodner | 416/236 A |
| 3,514,215 | 5/1970 | Williams | 416/235 |
| 4,128,363 | 12/1978 | Fujikake et al. | 416/236 A |
| 4,189,281 | 2/1980 | Katagiri et al. | 416/236 A |
| 4,222,710 | 9/1980 | Katagiri et al. | 416/236 A |

FOREIGN PATENT DOCUMENTS

| | | | |
|---|---|---|---|
| 416 | of 1871 | United Kingdom | 416/236 A |

*Primary Examiner*—Edward K. Look
*Assistant Examiner*—Michael S. Lee
*Attorney, Agent, or Firm*—Spencer, Frank & Schneider

[57] ABSTRACT

An axial-flow fan-blade, with at least one profiled guide fin extending from the surface of each blade of the fan-blade, is able to control flow direction of the fluid and keep fluid flow speed stable; and, furthermore, offsets the centrifugal force (which is caused by rotation of the blade) with the centripetal force that is generated by pressure difference of the fluid flowing across both sides of each profiled guide fin. The fan blade minimizes turbulent flow, reduces noise generated by vibration of the blades, and increases rigidity of the blades.

16 Claims, 3 Drawing Sheets

AXIAL-FLOW FAN-BLADE WITH PROFILED GUIDE FINS

BACKGROUND OF THE INVENTION

This invention relates to the configuration of an axial-flow fan-blade where several profiled guide fins are extruded on the surface of each blade.

DESCRIPTION OF THE PRIOR ART

FIGS. 1 and 2 are the front view and side view, respectively, of a conventional prior art axial-flow fan which comprises an axial portion 1 and several fan-blades 2. When the fan is activated by a power (not shown) the fan rotates in the counter-clockwise direction R. Upon rotation of the fan in the direction R, the air or other kind of fluid N behind the fan-blades will be sucked and pushed forward to the front of the fan by the fan blades 2 as output fluid X. The reference to "behind" and "front" of the fan is in the context of FIGS. 1 and 2 and may be alternatively described as "left" and "right" sides as the fan is illustrated in FIG. 1.

The output fluid X includes three flow components, a major flow component x1 which flows forward, a reverse flow component x2 that overflows due to centrifugal force and pressure difference of fluids at the outside rim of the blades, and a turbulent flow component x3 which flows into a static area V in front of the axial portion 1 of the fan-blades. The reference to "overflow" means that fluid flows from the front of the fan to "behind" the fan. The three fluid flow components result in uneven fluid flow at different sections of the fan.

Noise is generated because of vibration of the blades 2 and turbulence of the fluid flow. Furthermore, because of the smooth surfaces of the fan-blades, the blades 2 can not effectively convey fluid and control flowing motion of the fluid X, and the fluid on the surface of the blades 2 will slip off radially. As the fluid moves radially of the fan blades there will be a decrease in the pressure difference of fluids N and X, in front and rear of the fan-blade, respectively, thus the fluid X would not be able to flow to a long distance from the fan.

There are additional problems with the prior art fan of FIGS. 1 and 2. For example, in the circumstance where the fan operates at different rotational speeds, the centrifugal slip-off volumes of the fluid x2 are different at these different speeds and the flowing movement of the fluid X can not be effectively controlled. Moreover, when the fan-blades are used as a fluid driving source of a heat-exchanger, and with the fan installed close to that heat-exchanger as required, the uneven distribution of flowing fluid X will cause a negative effect to the heat-exchanger, i.e., a reduction of efficiency. Furthermore, when the fan-blades are rotating at high speed, a strong centrifugal force is generated. To accommodate strong centrifugal forces, a strong reliable, safe fan-blade design is required.

SUMMARY OF THE INVENTION

To solve the above-mentioned problems, this invention provides an axial-flow fan-blade extruded with at least one profiled guide fin on the surface of each blade.

A first object of this invention is to provide an axial-flow fan-blade which conveys and controls the flowing direction of the fluid.

A second object of this invention is to provide an axial-flow fan-blade which restrains or prevents the centrifugal effect from causing overflow and reverse flow, thus the present invention provides an increase in flow efficiency.

A third object of this invention is to provide an axial-flow fan-blade which results in decreased noise and decreased pressure loss from the centrifugal slip of the fluid on the fan-blade as compared to the prior art.

A fourth object of this invention is to provide an axial-flow fan-blade which is of increased blade rigidity, operates at a reduced noise level, and provides increased safety.

Another object of this invention is to provide an axial-flow fan-blade which offsets the centrifugal force while the fan-blade is rotating, thus allowing higher speed of rotation.

This invention, by extruding at least one and preferably several profiled guide fins on the surface of each blade, enables an axial-flow fan-blade to control the flowing direction of the fluid and maintain the fluid flow speed stable, and, furthermore, to increase the rigidity of the blades and reduce the noise generated from vibration of the blades and turbulent fluid flow, and finally to offset the centrifugal force which is caused by rotation of the blades, with a centripetal force that is generated by pressure difference of the fluid flowing along both sides of each profiled guide fin.

BRIEF DESCRIPTION OF THE DRAWINGS

The invention will be better understood, and further objects and advantages thereof will become more apparent, from the detailed description of the various embodiments taken in conjunction with the drawings. In the drawings, wherein like numerals identify corresponding components.

DETAILED DESCRIPTION OF THE PRESENT INVENTION

Figure 1:
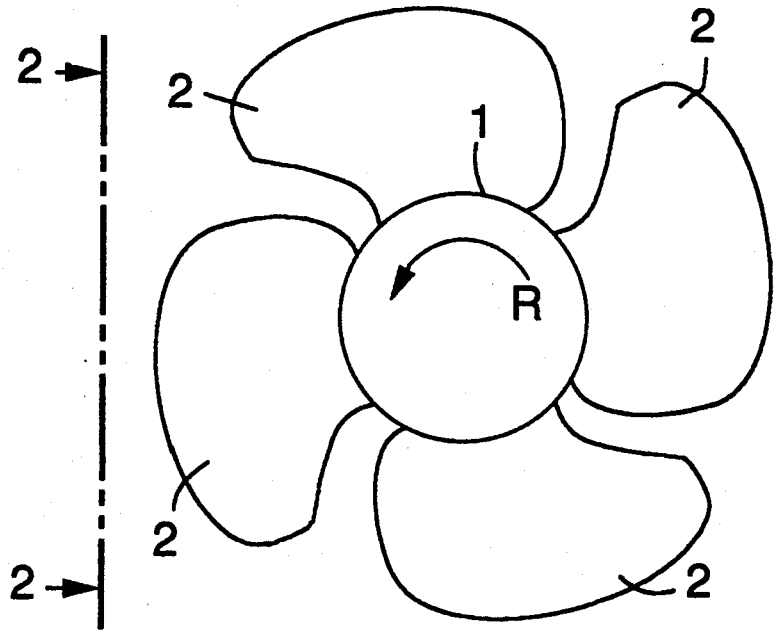
FIG. 1 PRIOR ART
FIG. 1 is a front view of a conventional prior art axial-flow fan.
Figure 2:
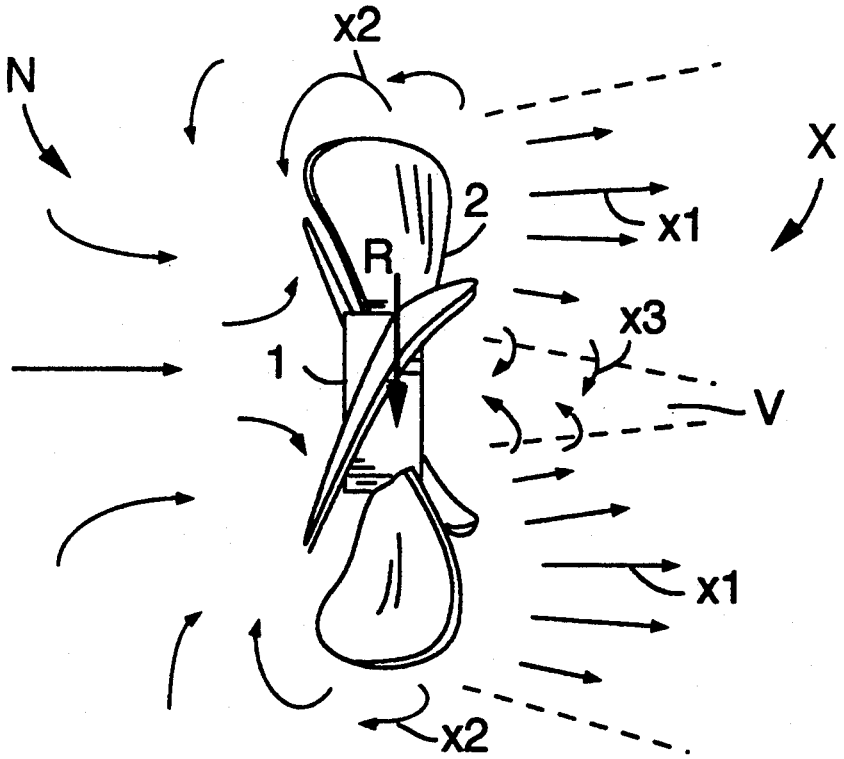
FIG. 2 PRIOR ART
FIG. 2 is a side view taken in the direction 2—2 of FIG. 1 and shows the function of the fan which has been described before.
Figure 3:
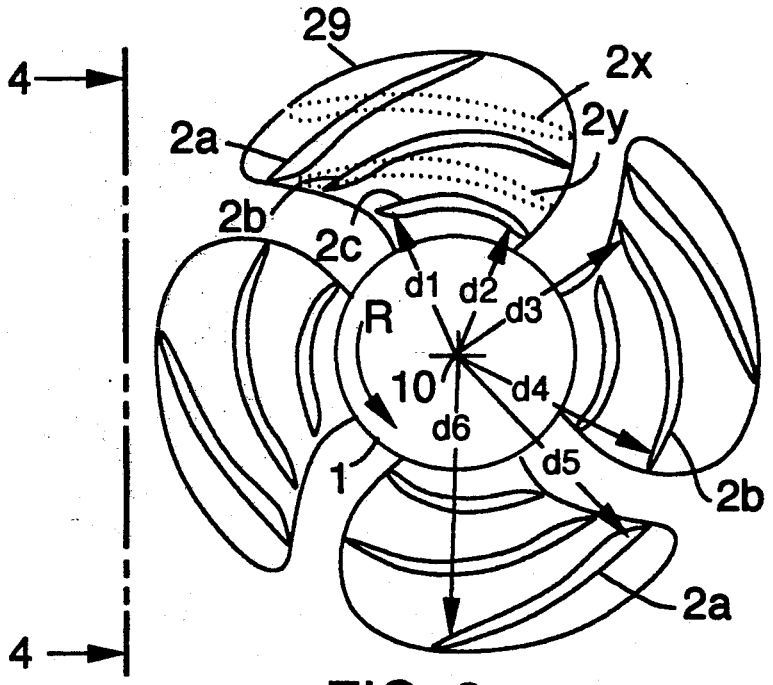
FIG. 3 is a front view of one embodiment of a fan-blade of this invention.
Figure 4:
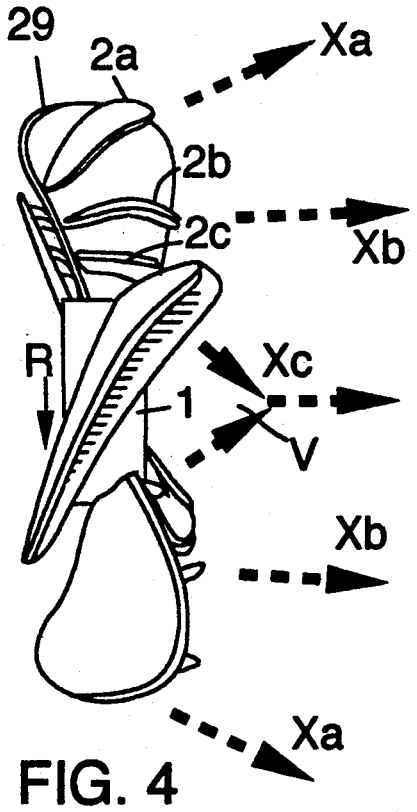
FIG. 4 is a side view and functional illustration taken in the direction 4—4 of FIG. 3.

An embodiment of this invention, as shown in FIG. 3 and FIG. 4, includes at least one and preferably several extruded profiled guide fins 2*a*, 2*b*, 2*c*, etc. on the surface of each blade 29 of a general axial-flow fan-blade. The guide fins increase the rigidity of the blades 29 and reduce vibration and noise as fluid strikes the fan-blades. The guide fins may be designed to conduct fluid to flow in different directions based on various requirements of specific fans based upon the intended use of the fan.

The fan of FIG. 3 is illustrated as rotating in a counterclockwise direction R about an axis 10. The guide fin 2c located closest to the axis 10 as shown in FIG. 3, has a distance measured from the axis 10 which distance is reduced gradually from the front-end distance d1 to the rear-end distance d2 along the rotation direction R. This gradual curvature or reduction in distance will force the discharge fluid flow Xc shown in FIG. 4 toward the axial portion 1. Stated alternatively, the curvature of fin 2c causes a convergence or narrowing of fluid flow resulting in a static area V sheltered by the axial portion 1 and provides uniform discharge flow even at the area close to the fan-blade. The guide fin 2b, located in the middle of the surface of the blade 29, has a front-end distance d3 and a rear-end distance d4 which are approximately equal. When measured from axis 10. Fin 2b will guide the discharge flow Xb to flow in parallel relative to axis 10. Finally the profiled guide fin 2a, located in the outer rim of the surface of the blade 29, (farthest from the axis 10) has a rear-end distance d6 which exceeds the front-end distance d5. The gradual curvature or increase in distance from d5 to d6 will force the discharge flow Xa to expand or diverge its flowing area.

The above mentioned profiled guide fins 2a, 2b, 2c, etc. are all located in the front side of each blade 29. The other side (the rear side) of each blade 29 can also be furnished with similar profiled guide fins 2x, 2y, etc. All these profiled guide fins not only have the function of controlling flow direction, but also increase the rigidity of each blade 29. The number of guide fins, their shapes, the distance between adjacent fins, the height and profile of every guide fin, meet various requirements of the specific uses of the fan. This will be better understood from the following detailed description of embodiments.

The number of profiled guide fins on each fan-blade can be adjusted as required. However, for the adjacent profiled guide fins, the angular variation should not exceed the degree that will generate divergency of fluid, (to the airflow, it is 7.5 degree) so as to insure that the fluid be conducted with a stable laminar flow.

Figure 5:
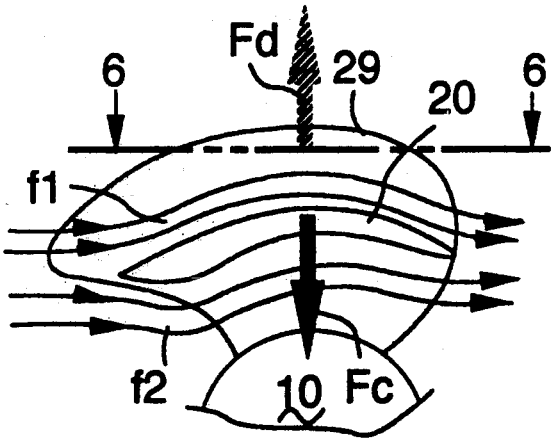
FIG. 5 is a functional illustration of centripetal force generated from a profiled guide fin on the surface of a fan-blade according to the invention.

FIG. 5 shows a profiled guide fin 20 on a blade 29 where a centripetal force Fc is generated by the profile of the guide fin 20. The curve length of the fin 20 at the surface facing the axis 10 (inner side) is longer than the curve length on the other side (outerside), i.e., the surface remote from the axis 10. With the outer surface longer than the inner surface, the flow speeds of fluids f1 and f2 across the two surfaces of the guide fin 20 are different, resulting in a relative pressure difference which generates centripetal force Fc toward the axis 10. The centripetal force will offset the centrifugal force Fd created by the rotation of the blade 29 and this allows the fan-blade to rotate at higher speed. Furthermore, balancing or offsetting centrifugal force with centripetal force reduces vibration and noise.

Figure 6:
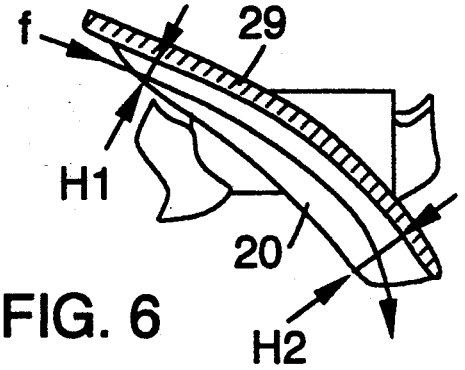
FIG. 6 is a side view of a profiled guide fin taken in the direction 6—6 of FIG. 5.

FIG. 6 is a side view of the profiled guide fin 20 taken in the direction 6—6 of FIG. 5, which shows that the height of guide fin 20 on the surface of blade 29 can be suitably adjusted to meet specific requirements. For example, the heights H1 and H2, from entry to exit, along the direction of fluid flow, may increase gradually as shown, or maybe equal to each other or be varied in other ways. The height of different guide fins can be varied as well. For example, in order to prevent the fluid from flowing outside (caused by the effect of centrifugal force) and to increase the efficiency of the blade, it is recommended to have a higher height for fins near the axis 10 and a lower height for fins away from the axis 10. The guide fin 20 generally stands perpendicularly relative to the surface of the blade 29. However the fin may be inclined toward the axis 10 for enhancing the guiding effect. The guide fins can be trimmed or drilled in the proper position to remove some materials when dynamic balance of the fan-blade needs to be adjusted.

The angled or curvature arrangement of each profiled guide fine 20 can be designed to meet various requirements, for example, to make the discharge flow area expanded (divergent), parallel or concentrated (convergent). The typical embodiments are shown in FIGS. 7, 8, 9, and 10.

Figure 7:
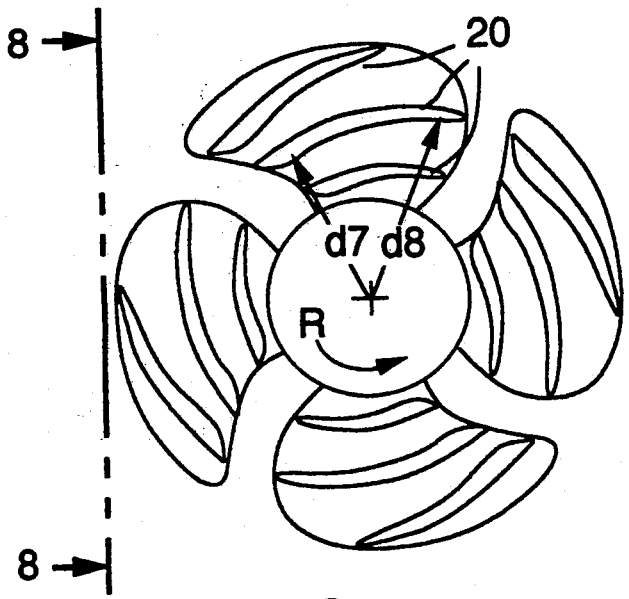
FIG. 7 is a front view of another embodiment of a fan-blade of the present invention.
Figure 8:
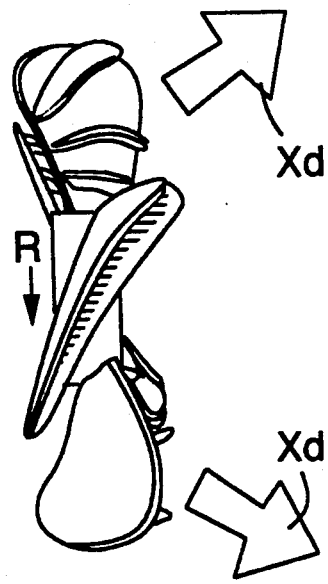
FIG. 8 is a side view and functional illustration taken in the direction 8—8 of FIG. 7.

FIGS. 7 and 8 illustrate fan blades where the front distance d7 of each fin is smaller than the rear distance d8 when viewed. Each fin is gradually expanded from front to rear, i.e., the distance from axis 10 along the rotation direction R increases, such that each guide fin 20 forces the discharge flow Xd to expand or diverge.

Figure 9:
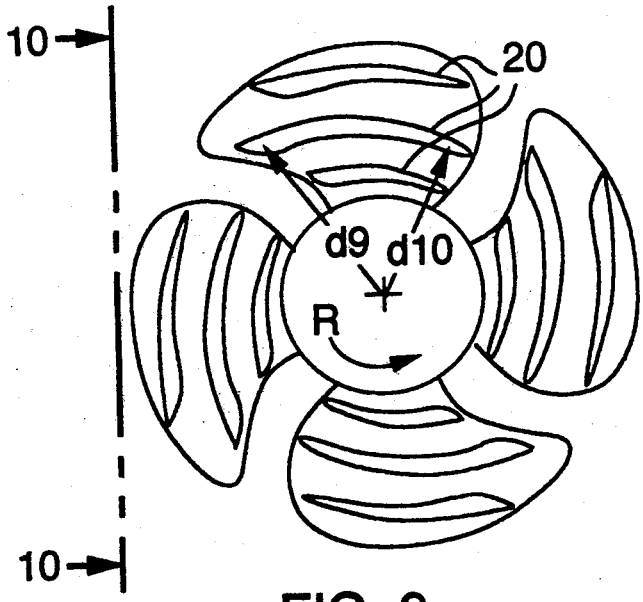
FIG. 9 is a front view of still another embodiment of the fan-blade of this invention.
Figure 10:
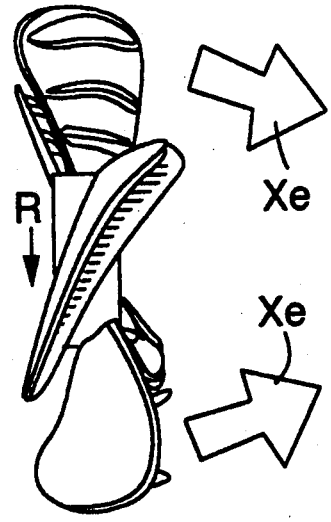
FIG. 10 is a side view and functional illustration taken in the direction 10—10 of FIG. 9.

FIG. 9 is an embodiment for concentrated flow or converging flow and FIG. 10 is a side view and functional illustration showing that each guide fin 20 forces the discharge flow Xe to concentrate since the front end distance d9 is gradually reduced to a smaller rear-end distance d10 relative to the fan axis 10.

Each profiled guide fin or a fan-blade of the invention can be produced with the blade simultaneously; or be manufactured individually, and assembled to the fan-blade afterwards.

The fan-blades of this invention can be used in an air conditioner to provide a broader heat dissipation area, higher wind strength and lower noise. The fan-blades can also be used in an exhaust fan to provide greater pressure difference and better efficiency. Similarly the fan-blades of this invention may be used on a tail rotor of a helicopter to enhance stability, or applied to a propeller of a ship to decrease cavitation, and increase speed and stability.

While the invention has been described by reference to specific embodiments chosen for purposes of illustration, it should be apparent that numerous modifications could be made thereto by those skilled in the art without departing from the spirit and scope of the invention.

What is claimed is:

1. An axial-flow fan having a axial portion formed along an axis and several fan blades installed around said axial portion;

each fan blade being defined as having two surfaces positioned relative to said axis;

the rotation of said fan blades causing fluid flow through said blades, said fluid flow causing centrifugal force; and means for producing centripetal force to balance said centrifugal force;

said centripetal force producing means including at least one fin extending from at least one of said surfaces of said fan blade;

each fin having an inner surface and an outer surface relative to the axis; and the length of the fin measured along the outer surface being shorter than the length of the fin measured along the inner surface for producing said centripetal force.

2. The axial flow fan as defined in claim 1 wherein said means for producing centripetal force includes at least one fin on at least one surface of said fan blade;

each fin having a front end and a rear end relative to the direction of rotation; and said front end and said rear end being the same distance from said axis for providing parallel fluid flow relative to said axis.

3. The axial flow fan as defined in claim 1 wherein said centripetal force producing means includes at least one fin extending from at least one surface of said fan blade;

wherein each fin has a front end and a rear end relative to the direction of rotation;

said front end being at a greater distance from said axis than said rear end for providing converging fluid flow relative to said axis.

4. The axial flow fan as defined in claim 1 wherein said centripetal force producing means includes at least one fin extending from at least one surface of said fan blade;

wherein each fin has a front end and a rear end relative to the direction of rotation;

said front end being at a lesser distance from said axis than said rear end for providing diverging fluid flow relative to said axis.

5. The axial flow fan as defined in claim 1 wherein each fan blade includes at least two fins.

6. The axial flow fan as defined in claim 1 wherein each fan blade includes at least two fins, the fins of a specific fan blade extending from two different surfaces of said fan blade.

7. The axial flow fan as defined in claim 1 wherein each fan blade includes at least first and second fins;

each of said first and second fins having a front end and a rear end relative to the direction of rotation;

said front end of said first fin being at a greater distance from said axis than said rear end of said first fin for providing converging fluid flow relative to said axis; and said front end of said second fin being at a lesser distance from said axis than said rear end of said second fin for providing diverging fluid flow relative to said axis.

8. The axial flow fan as defined in claim 7 wherein the fins of a specific fan blade extend from two different surfaces of said fan blade.

9. An axial-flow fan having a axial portion formed along an axis and several fan blades installed around said axial portion;

each fan blade being defined as having two surfaces positioned relative to said axis;

the rotation of said fan blades causing fluid flow through said blades, said fluid flow causing centrifugal force; and means for producing centripetal force to balance said centrifugal force;

said means for producing centripetal force including at least one fin on at least one surface of said fan blade;

each fin having a front end and a rear end relative to the direction of rotation; and said front end and said rear end being the same distance from said axis for providing parallel fluid flow relative to said axis.

10. The axial flow fan as defined in claim 9 wherein said centripetal force producing means includes at least one fin extending from at least one of said surfaces of said fan blade;

each fin having an inner surface and an outer surface relative to the axis; and the length of the fin measured along the outer surface being shorter than the length of the fin measured along the inner surface for producing said centripetal force.

11. The axial flow fan as defined in claim 9 wherein said centripetal force producing means includes at least one fin extending from at least one surface of said fan blade;

wherein each fin has a front end and a rear end relative to the direction of rotation;

said front end being at a greater distance from said axis than said rear end for providing converging fluid flow relative to said axis.

12. The axial flow fan as defined in claim 9 wherein said centripetal force producing means includes at least one fin extending from at least one surface of said fan blade;

wherein each fin has a front end and a rear end relative to the direction of rotation;

said front end being at a lesser distance from said axis than said rear end for providing diverging fluid flow relative to said axis.

13. The axial flow fan as defined in claim 9 wherein each fan blade includes at least two fins.

14. The axial flow fan as defined in claim 9 wherein each fan blade includes at least two fins, the fins of a specific fan blade extending from two different surfaces of said fan blade.

15. The axial flow fan as defined in claim 9 wherein each fan blade includes at least first and second fins;

each of said first and second fins having a front end and a rear end relative to the direction of rotation;

said front end of said first fin being at a greater distance from said axis than said rear end of said first fin for providing converging fluid flow relative to said axis; and said front end of said second fin being at a lesser distance from said axis than said rear end of said second fin for providing diverging fluid flow relative to said axis.

16. The axial flow fan as defined in claim 15 wherein the fins of a specific fan blade extend from two different surfaces of said fan blade.

* * * * *